US008327504B2

(12) United States Patent
Helps et al.

(10) Patent No.: US 8,327,504 B2
(45) Date of Patent: Dec. 11, 2012

(54) WAND ASSEMBLY FOR A CLEANING APPLIANCE

(75) Inventors: Daniel Francis Helps, Malmesbury (GB); Christopher Simon Osborn, Malmesbury (GB); Blair Hugh Hutton, Malmesbury (GB); Alan Glynn Sanderson, Malmesbury (GB); Hadley White, Malmesbury (GB)

(73) Assignee: Dyson Technology Limited, Malmesbury (GB)

( * ) Notice: Subject to any disclaimer, the term of this patent is extended or adjusted under 35 U.S.C. 154(b) by 615 days.

(21) Appl. No.: 12/338,785

(22) Filed: Dec. 18, 2008

(65) Prior Publication Data

US 2009/0158548 A1 Jun. 25, 2009

(51) Int. Cl.
*A47L 9/00* (2006.01)

(52) U.S. Cl. ..... 15/355; 15/331; 15/334; 15/336

(58) Field of Classification Search ..... 15/331, 15/334, 335, 336
See application file for complete search history.

(56) References Cited

U.S. PATENT DOCUMENTS

| | | | | |
|---|---|---|---|---|
| 2,660,457 | A | 11/1953 | Mallon | |
| 2,867,833 | A | 1/1959 | Duff | |
| 4,377,882 | A | 3/1983 | Dyson | |
| 4,519,113 | A | 5/1985 | Hipple | |
| 4,573,236 | A | 3/1986 | Dyson | |
| 4,955,106 | A | 9/1990 | Stein et al. | |
| 4,989,295 | A | 2/1991 | Guehne et al. | |
| 5,054,157 | A | 10/1991 | Werner et al. | |
| 5,331,715 | A | 7/1994 | Johnson et al. | |
| 5,358,290 | A | 10/1994 | Fleet et al. | |
| 5,462,311 | A | 10/1995 | Cipolla | |
| 5,867,862 | A | 2/1999 | Ahlf et al. | |
| 6,032,328 | A * | 3/2000 | Harmon et al. | 15/421 |
| 6,108,861 | A | 8/2000 | Vystrcil et al. | |
| 6,158,089 | A | 12/2000 | Monahan et al. | |
| 7,877,837 | B2 * | 2/2011 | Gammack et al. | 15/323 |
| 7,891,050 | B2 | 2/2011 | Liddell | |
| 2003/0101535 | A1 | 6/2003 | Gammack et al. | |
| 2004/0111828 | A1 | 6/2004 | Evans | |
| 2007/0072460 | A1 | 3/2007 | Stahle et al. | |
| 2007/0248406 | A1 | 10/2007 | Stahle et al. | |
| 2008/0131195 | A1 | 6/2008 | Stahle et al. | |

(Continued)

FOREIGN PATENT DOCUMENTS

CA 2374892 9/2002

(Continued)

OTHER PUBLICATIONS

Partial International Search Report directed to corresponding PCT/GB2008/004019; 2 pages.

(Continued)

*Primary Examiner* — Lee D Wilson
*Assistant Examiner* — Shantese McDonald
(74) *Attorney, Agent, or Firm* — Morrison & Foerster LLP

(57) ABSTRACT

A wand assembly for a cleaning appliance includes a handle portion having a channel formed therethrough; a tubular wand received within the channel and moveable between a first position and a second position; a locking mechanism having a lock position and an unlock position and preventing the wand from moving from the first position when in the lock position; and a release mechanism mounted to the wand and which can be actuated to move the locking mechanism from the lock position to the unlock position. The release mechanism is actuated by relative movement of the release mechanism with respect to the wand.

24 Claims, 7 Drawing Sheets

U.S. PATENT DOCUMENTS

| | | | |
|---|---|---|---|
| 2008/0244860 | A1 | 10/2008 | Gammack et al. |
| 2009/0038111 | A1 | 2/2009 | White et al. |
| 2009/0038112 | A1 | 2/2009 | Wood |
| 2010/0000044 | A1 | 1/2010 | Sanderson et al. |

FOREIGN PATENT DOCUMENTS

| | | |
|---|---|---|
| CN | 1136270 | 11/1996 |
| CN | 2347538 | 11/1999 |
| CN | 1284843 | 2/2001 |
| CN | 2669782 | 1/2005 |
| CN | 200946612 | 9/2007 |
| CN | 101053500 | 10/2007 |
| CN | 201324205 | 10/2009 |
| DE | 20 2007 005 035 | 9/2007 |
| EP | 0 037 674 | 10/1981 |
| EP | 0 134 654 | 3/1985 |
| EP | 0537457 | 4/1993 |
| EP | 0937435 | 8/1999 |
| EP | 1 265 519 | 12/2002 |
| EP | 1 380 247 | 1/2004 |
| GB | 2 329 944 | 4/1999 |
| GB | 2359735 | 9/2001 |
| GB | 2392827 | 3/2004 |
| GB | 2 396 896 | 7/2004 |
| GB | 2 413 943 | 11/2005 |
| GB | 2 416 296 | 1/2006 |
| GB | 2 439 915 | 1/2008 |
| GB | 2440718 | 2/2008 |
| JP | 45-545 | 1/1970 |
| JP | 56-91558 | 7/1981 |
| JP | 3-261434 | 11/1991 |
| JP | 4-303406 | 10/1992 |
| JP | 2005-143724 | 6/2005 |
| JP | 2007-185222 | 7/2007 |
| WO | WO-97/33510 | 9/1997 |
| WO | WO-01/65989 | 9/2001 |
| WO | WO-03/101273 | 12/2003 |
| WO | WO-2005/079648 | 9/2005 |
| WO | WO-2005/110178 | 11/2005 |
| WO | WO-2006/008443 | 1/2006 |
| WO | WO-2006/008444 | 1/2006 |

OTHER PUBLICATIONS

International Search Report and Written Opinion mailed Jul. 24, 2009, directed to corresponding PCT/GB2008/004019; 18 pages.

Great Britian search report mailed on Mar. 26, 2008 directed at counterpart application GB0725133.3; 1 page.

Gammack, P. et al., U.S. Office Action mailed Jun. 24, 2010, directed to U.S. Appl. No. 11/632,851; 12 pages.

Gammack, P. et al., U.S. Office Action mailed Dec. 10, 2010, directed to U.S. Patent Appl. No. 11/632,851; 15 pages.

Gammack, P. et al., U.S. Office Action mailed Oct. 14, 2011, directed to U.S. Appl. No. 11/632,851; 14 pages.

White, R., et al., U.S. Office Action mailed Feb. 10, 2011, directed to U.S. Appl. No. 12/184,858; 6 pages.

Search Report dated Jun. 14, 2012 directed to GB Application No. 1210012.9; 2 pages.

Search Report dated Jun. 14, 2012 directed to GB Application No. 1210011.1; 1 page.

Wood, R. M., U.S. Office Action mailed Mar. 30, 2011, directed to U.S. Appl. No. 12/185,635; 7 pages.

* cited by examiner

WAND ASSEMBLY FOR A CLEANING APPLIANCE

REFERENCE TO RELATED APPLICATION

This application claims the priority of United Kingdom Application No. 0725133.3, filed Dec. 22, 2007, the contents of which are incorporated herein by reference.

FIELD OF THE INVENTION

The invention relates to a wand assembly for a cleaning appliance, particularly but not exclusively an upright vacuum cleaner.

BACKGROUND OF THE INVENTION

Upright vacuum cleaners generally include a wand assembly for above-the-floor cleaning. A changeover arrangement is often provided for switching the air intake between the main cleaner head and the wand assembly. The changeover arrangement may be actuated by the position of the body of the vacuum cleaner such that air is drawn in through the cleaner head when the body is in a reclined position, and air is drawn in through the wand assembly when the body is in a fully upright position. However, there may be instances when a user wishes to use the main cleaner head with the vacuum cleaner in the fully upright position. Additionally, upright vacuum cleaners are generally powered on with the body in the fully upright position; this is particularly true of vacuum cleaners that are unbalanced in the reclined position. Consequently, a user may incorrectly believe that a problem exits with the vacuum cleaner upon power-on since air would be drawn in through the wand assembly rather than the main cleaner head, as might be expected.

Rather than actuating the changeover arrangement in response to the position of the vacuum cleaner, the changeover arrangement may alternatively be actuated in response to stowing and removing the wand assembly from the vacuum cleaner. In this alternative arrangement, the wand assembly typically engages a component of the changeover arrangement, which is moveable between two positions. In a first position the changeover arrangement selects the wand assembly, while in a second position the cleaner head is selected. The component is biased (e.g. by means of a spring) towards the first position such that, when the wand assembly is removed from the vacuum cleaner, the changeover arrangement automatically selects the wand assembly. In contrast, when the wand assembly is stowed on the vacuum cleaner, the wand assembly applies a force to the component in opposition to the biasing force, thereby causing the component to move to the second position and the changeover arrangement to select the main cleaner head.

A problem with this type of changeover arrangement is that the wand assembly must be securely held in place when stowed on the vacuum cleaner. Without securing the wand assembly, vibration that occurs during use of the vacuum cleaner, as well as any biasing forces from the changeover arrangement, may cause the position of the wand assembly to move. Any movement in the position of the wand assembly is then translated to the changeover arrangement resulting in a loss of suction at the main cleaner head. However, securing the wand assembly to the vacuum cleaner has its own problems. In particular, locking mechanisms are typically cumbersome and require both hands in order to unlock and remove the wand assembly from the vacuum cleaner. Additionally, changing from upright to above-the-floor cleaning typically involves three different actions: unlocking the wand assembly; removing the wand assembly from the main body of the vacuum cleaner; and extending the telescopic wand. The same three actions must then be repeated in reverse when reverting to upright cleaning, all of which may seem tiresome and overcomplicated to the user.

SUMMARY OF THE INVENTION

The present invention therefore seeks to provide an improved wand assembly for use with a cleaning appliance, particularly, though not exclusively, an upright vacuum cleaner.

Accordingly, in a first aspect, the present invention provides a wand assembly for a cleaning appliance comprising: a handle portion having a channel formed therethrough; a tubular wand received within the channel and moveable within the channel between a first position and a second position; locking mechanism moveable between a lock position and an unlock position, the locking mechanism preventing movement of the wand from the first position when in the lock position and permitting movement of the wand from the first position when in the unlock position; and a release mechanism mounted to the wand and actuatable to move the locking mechanism from the lock position to the unlock position, wherein the release mechanism is actuated by relative movement of the release mechanism with respect to the wand.

Preferably, the release mechanism is adapted such that applying a first force to the release mechanism causes the release mechanism to move relative to the wand to actuate the release mechanism and applying a subsequent second force to the release mechanism cases the wand to move from the first position to the second position. This then has the advantage that a user is able to unlock and move the wand to the second position while maintaining a grasp of the release mechanism, i.e. the wand may be unlocked and moved using only one hand.

Advantageously, the first force and second force are in a direction from the first position to the second position. Consequently, the wand may be unlocked and moved upon application of a single directional force. Moreover, since the force is applied in a direction from the first position to the second position, the force is applied in a direction that intuitively brings about movement of the wand.

Conveniently, the handle portion is mountable to a support member of the cleaning appliance, and either the handle portion or the support member comprises a support catch. The support catch is moveable between a lock position and unlock position in which separation of the wand assembly from the cleaning appliance is respectively prevented and permitted. The wand assembly then further comprises a support-release member arranged to move the support catch from the lock position to the unlock position in response to the wand moving to the second position. This then aids the user to unlock and move the wand using only one hand since the handle portion is secured to the heavier cleaning appliance until such time as the wand is moved to the second position. Moreover, when the wand assembly is attached to a hose, this arrangement prevents possible damage to the hose by the wand.

Preferably, the handle portion is separated from the support member by moving the handle portion in a direction from the first position to the second position. Consequently, the wand may be unlocked and moved with the handle portion, and then the wand assembly may be unlocked and separated from the cleaning appliance, all by means of a single action.

Advantageously, the wand assembly comprises a further locking mechanism moveable between a lock position and an unlock position, the further locking mechanism preventing movement of the wand from the second position when in the lock position and permitting movement of the wand when in the unlock position. This then prevents the wand from inadvertently returning to the first position during use of the wand assembly.

Conveniently, the further locking mechanism is arranged to move from the lock position to the unlock position in response to mounting the handle portion to the support member. Consequently, the wand cannot be returned to the first position until such time as the wand assembly is mounted to the cleaning appliance. This then facilitates the return of the wand assembly to the cleaning appliance, particularly when a hose is attached to the wand assembly. Additionally, potential damage to the hose by the wand is avoided.

In a second aspect, the present invention provides a cleaning appliance comprising a cleaner head, a wand assembly, and a changeover arrangement operable to select one of the cleaner head and the wand assembly, wherein the wand assembly comprises: a handle portion having a channel formed therethrough; a tubular wand received within the channel and moveable within the channel between a first position and a second position; a locking mechanism moveable between a lock position and an unlock position, the locking mechanism preventing movement of the wand from the first position when in the lock position and permitting movement of the wand from the first position when in the unlock position; and a release mechanism mounted to the wand and actuatable by relative movement of the release mechanism with respect to the wand to move the locking mechanism from the lock position to the unlock position, and wherein the wand assembly is releasably mounted to the cleaning appliance and the changeover arrangement selects the cleaner head when the wand of the wand assembly is in the first position and selects the wand assembly when the wand is in the second position.

BRIEF DESCRIPTION OF THE DRAWINGS

In order that the present invention may be more readily understood, an embodiment of the invention will now be described, by way of example, with reference to the accompanying drawings, in which.

DETAILED DESCRIPTION OF THE INVENTION

Figure 1:
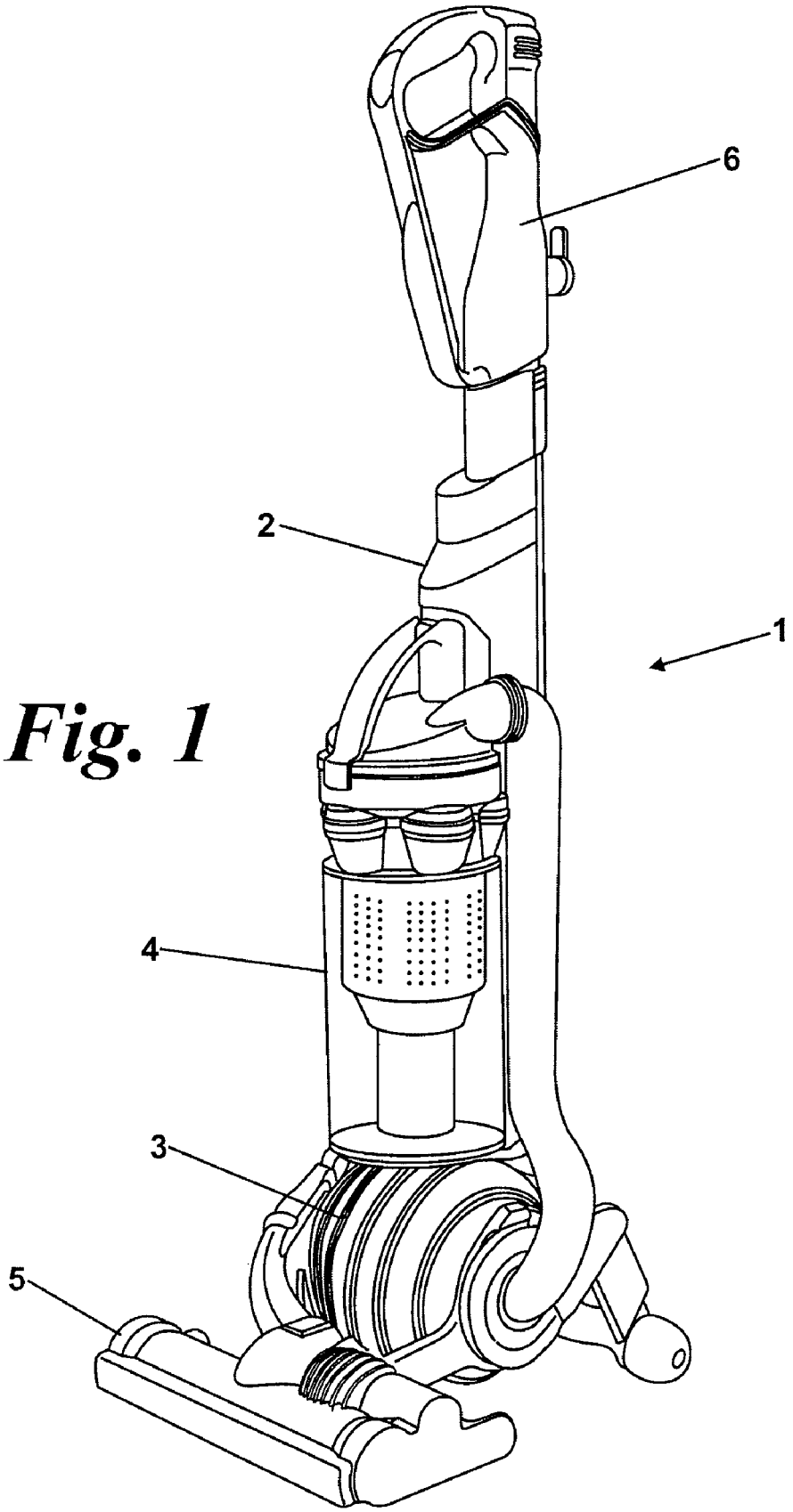
FIG. 1 is a perspective view of a vacuum cleaner incorporating a wand assembly according to the present invention.
Figure 2:
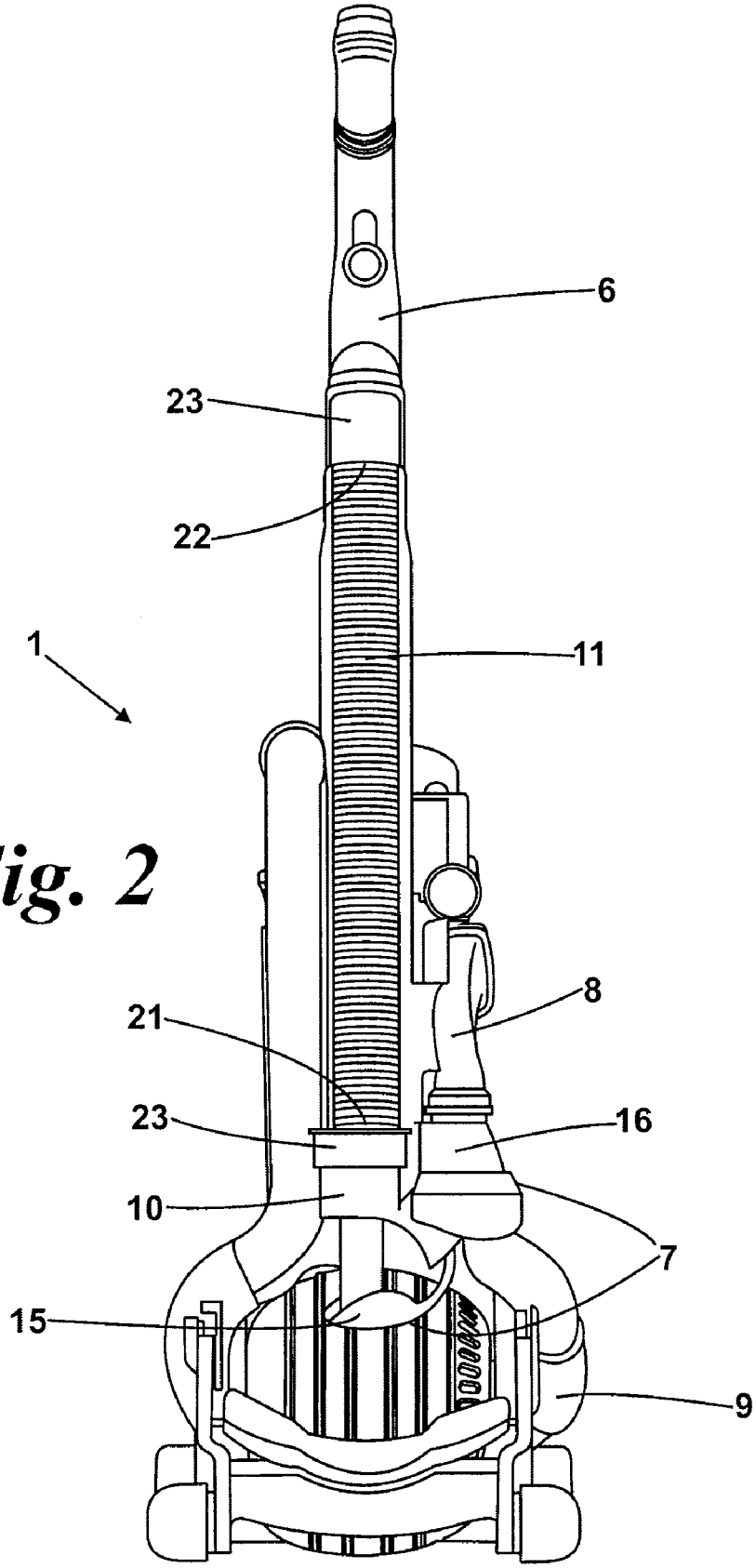
FIG. 2 is a rear view of the vacuum cleaner of FIG. 1.
Figure 3:
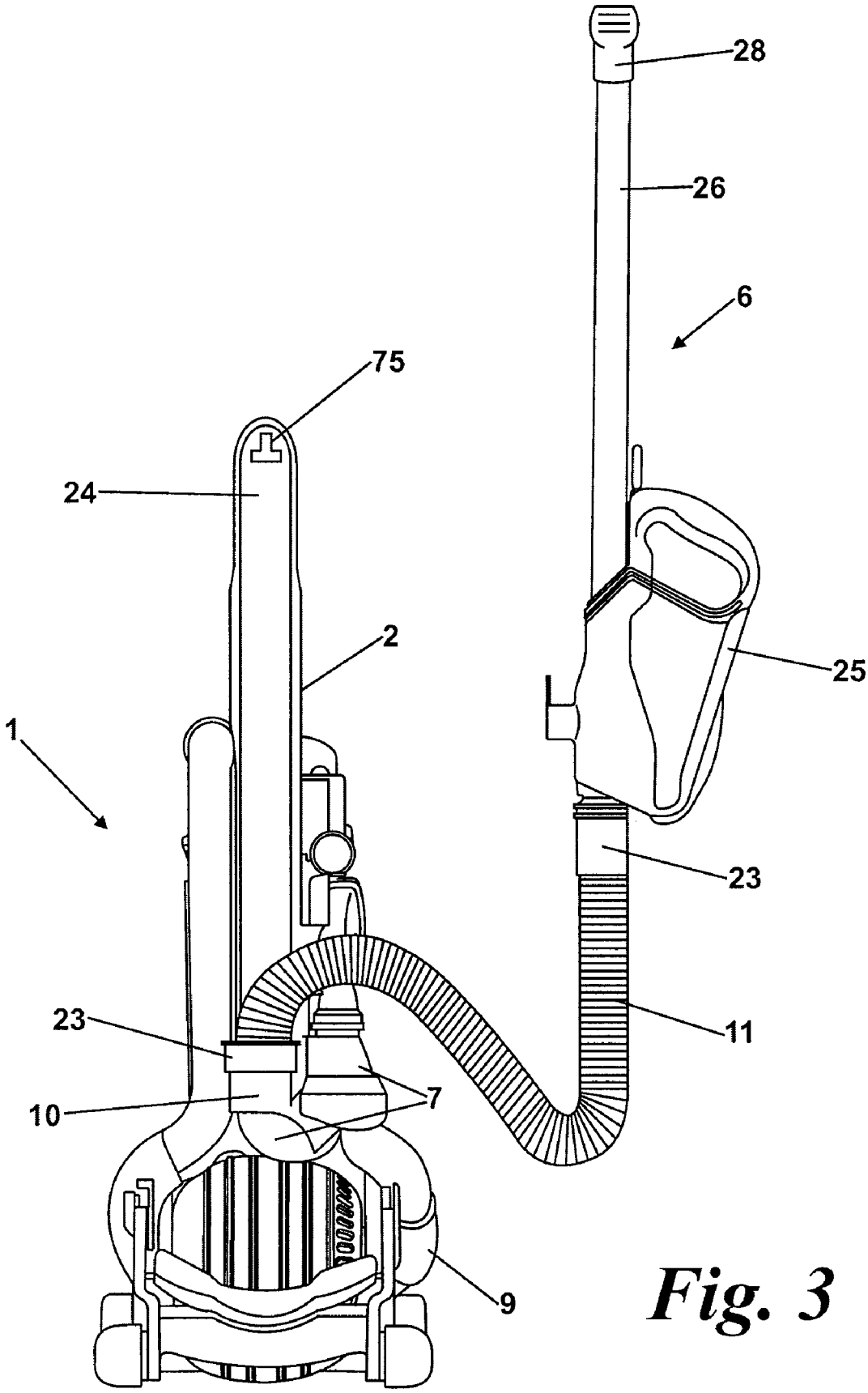
FIG. 3 is a rear view of the vacuum cleaner of FIG. 1 with the wand assembly separated from the body of vacuum cleaner.
Figure 4:
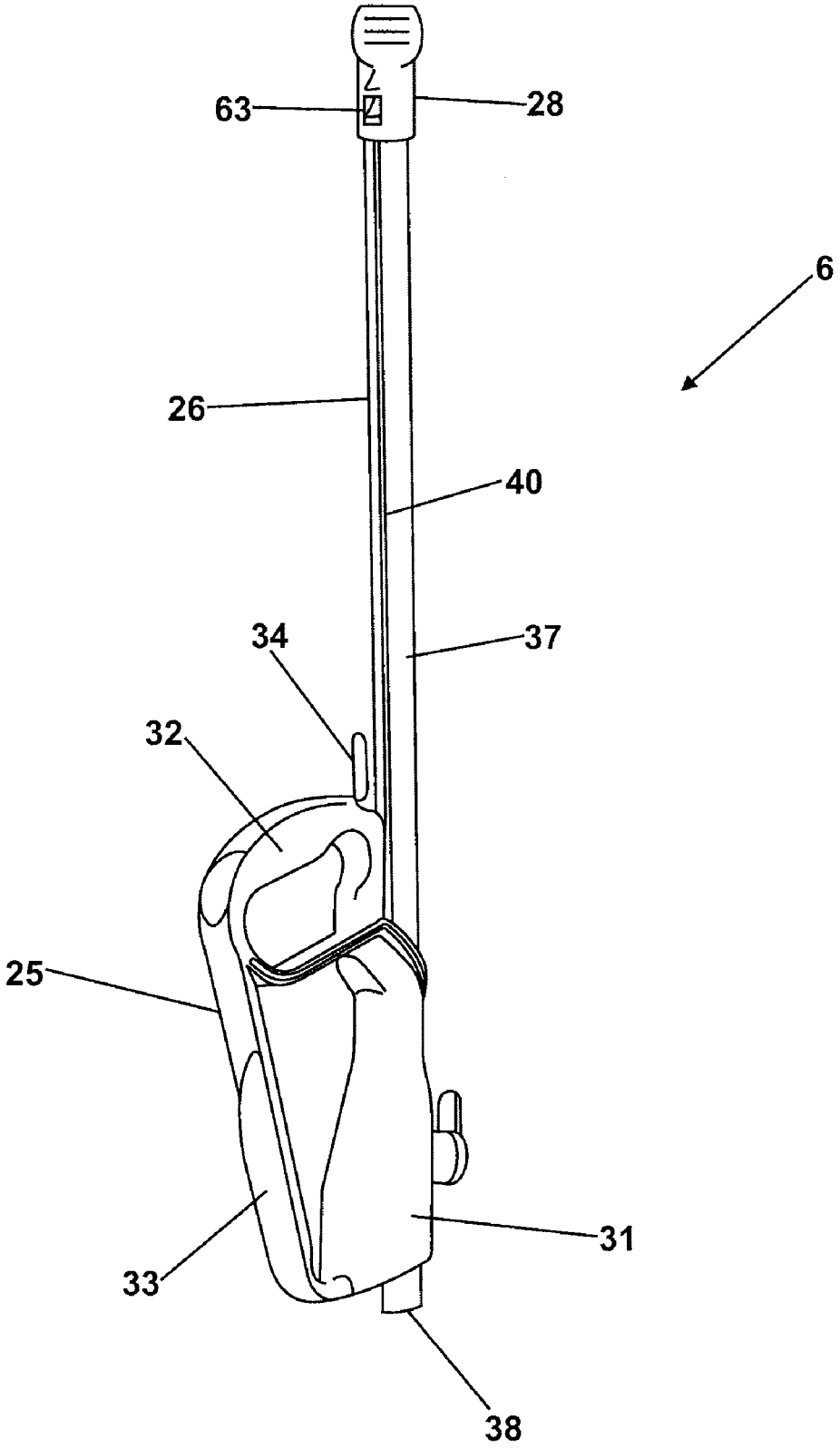
FIG. 4 is a perspective view of the wand assembly with the wand in a withdrawn position.

FIGS. 1 to 3 illustrate an upright vacuum cleaner 1 comprising a main body 2, a motor (not shown) housed within a motor housing 3, separating means 4, a cleaner head 5, a wand assembly 6, and a changeover arrangement 7.

In the embodiment illustrated, the separating means 4 comprises a cyclonic arrangement. However, alternative means for separating dirt entrained in a fluid flow may equally be employed. For example, the separating means 4 may alternatively comprise a filter, a bag or a combination of different known separation devices.

The vacuum cleaner 1 further comprises an inlet duct 8 coupled to the separating means 4, a head duct 9 coupled to the cleaner head 5, and a wand duct 10 coupled to the wand assembly 6 via a hose 11. As is described below, the changeover arrangement 7 selectively couples the inlet duct 8 with either the head duct 9, such that air is drawn in through the cleaner head 5, or the wand duct 10, such that air is drawn in through the wand assembly 6.

The wand duct 10 is substantially v-shaped and includes an aperture located at the bend in the duct 10. The wand duct 10 is coupled at one end to the hose 11 and at the other end to the inlet duct 8, when selected by the changeover arrangement 7.

The changeover arrangement 7 comprises a stirrup 15 coupled to valve means 16.

The stirrup 15 is substantially cup-shaped and is pivotally mounted to the wand duct 10. The stirrup 15 is pivotal between an open position and a closed position, and is biased towards the closed position by a torsion spring (not shown). In the closed position, the stirrup 15 covers and seals the aperture in the wand duct 10 (FIG. 3), while in the open position, the stirrup 15 pivots away from and exposes the aperture (FIG. 2).

The valve means 16 is coupled to both the stirrup 15 and the inlet duct 8, and is arranged to couple the inlet duct 8 to the head duct 9 when the stirrup 15 is in the open position, and to couple the inlet duct 8 to the wand duct 10 when the stirrup 15 is in the closed position. The changeover arrangement 7 is not pertinent to the present invention and thus the details of the valve means 16 will not be described here in any further detail.

The hose 11 is a sprung hose having a first end 21 connected to the wand assembly 6, and a second end 22 connected to the wand duct 10. Each end of the hose 11 includes a collar 23 having a resilient catch (not shown) such that the connections to the wand assembly 6 and the wand duct 10 are releasable, thereby facilitating maintenance and repair of the vacuum cleaner 1.

The wand assembly 6 has a stowed position (FIGS. 1 and 2) and a separated position (FIG. 3). When in the stowed position, the wand assembly 6 extends through the hose 11 and the wand duct 10, and applies a downward force to the stirrup 15 against the biasing force of the torsion spring. The stirrup 15 thus pivots to the open position and the valve means 16 selectively couples the inlet duct 8 to the head duct 9. When the wand assembly 6 is separated from the vacuum cleaner 1, the downward force applied by the wand assembly 6 to the stirrup 15 is removed and thus the biasing force of the torsion spring causes the stirrup 15 to pivot to the closed position. In response, the valve means 16 selectively couples the inlet duct 8 to the wand duct 10. Consequently, when the wand assembly 6 is stowed on the vacuum cleaner 1, air is drawn in through the cleaner head 5, and when the wand assembly 6 is separated from the vacuum cleaner 1, air is drawn in through the wand assembly 6.

The wand assembly 6 will now be described in detail with reference to FIGS. 4-7. For the purposes of clarity, the wand assembly 6 is shown separated from the hose 11. However, it will be appreciated that the wand assembly 6 would normally be attached to the hose 11, as illustrated in FIGS. 1 to 3.

Figure 5:
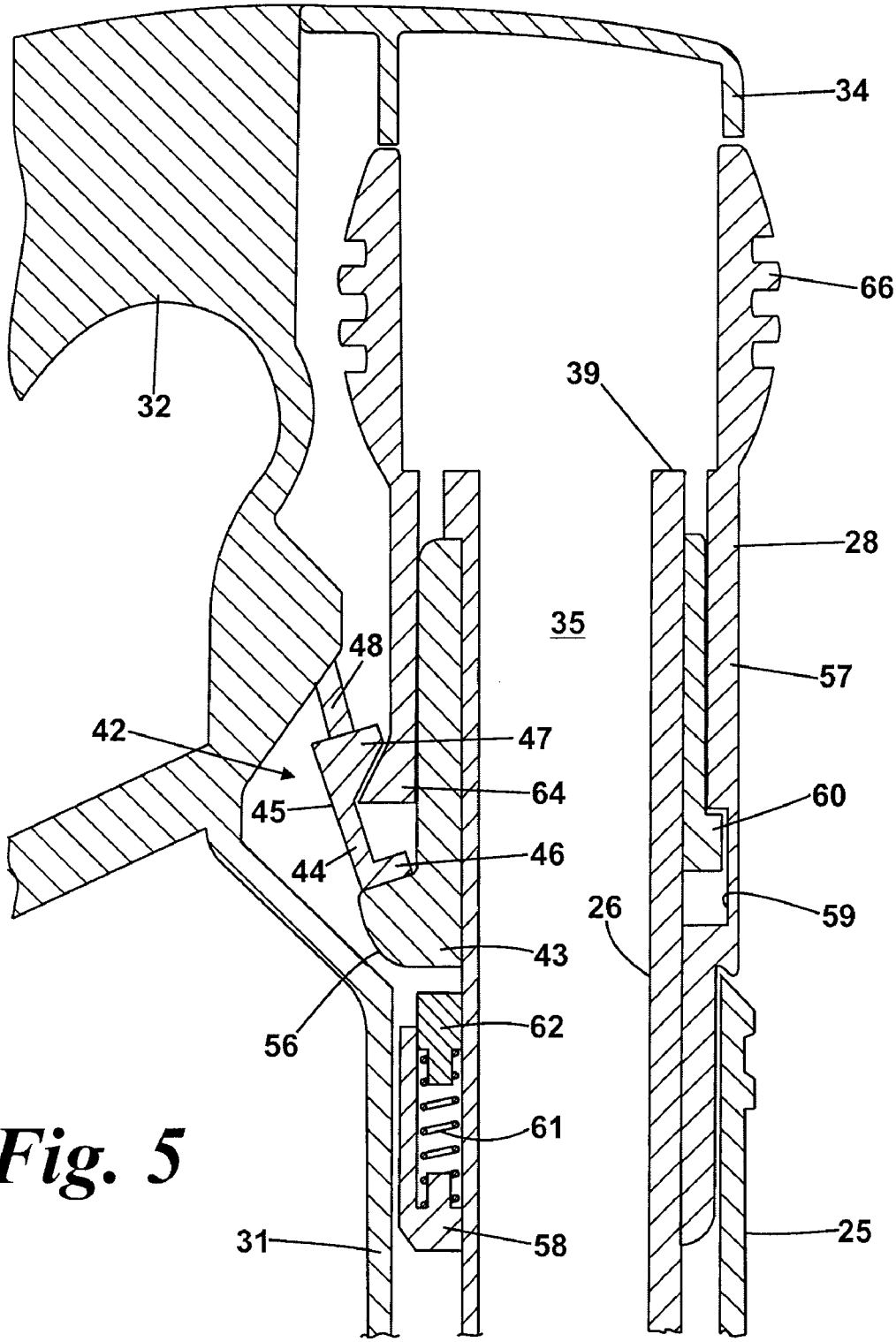
FIG. 5 is a cross-sectional view of a first part of the wand assembly with the wand in a retracted position and the first locking mechanism in a lock position.
Figure 6:
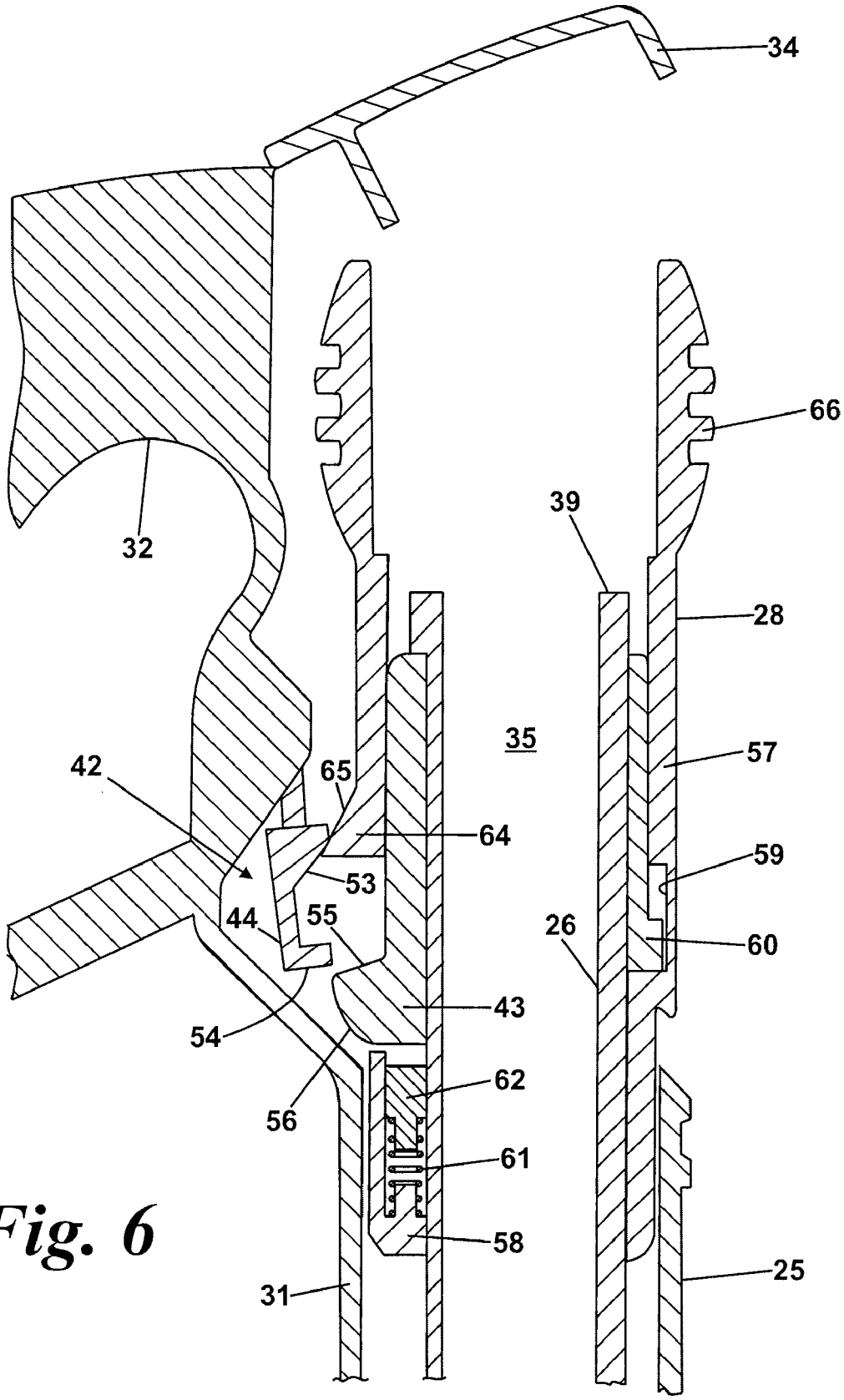
FIG. 6 is a cross-sectional view of the first part of the wand assembly with the wand in the retracted position and the first locking mechanism in an unlock position.
Figure 7:
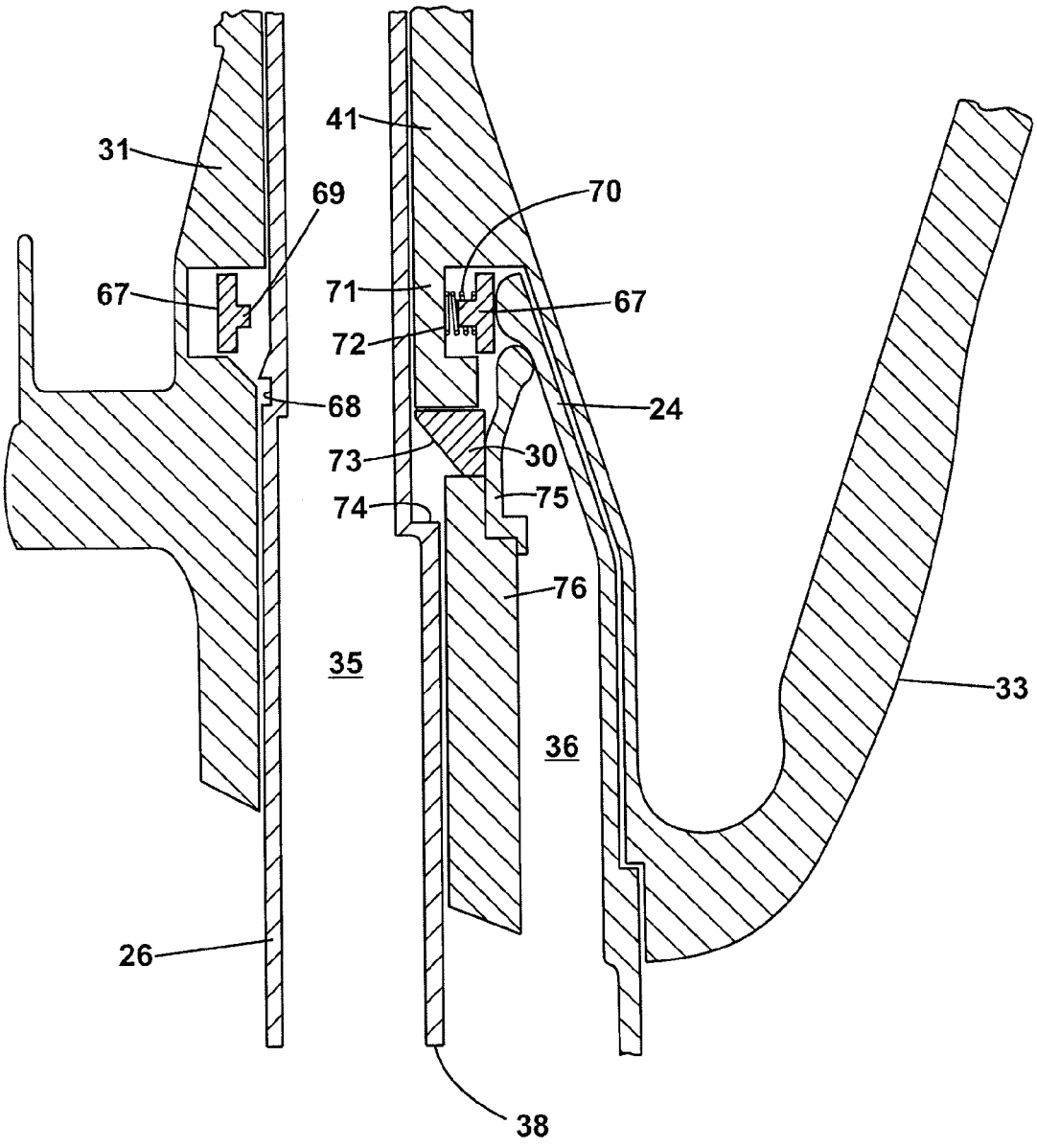
FIG. 7 is a cross-sectional view of a second part of the wand assembly, in which the wand assembly is mounted to the vacuum cleaner and the wand is proximate the withdrawn position.

The wand assembly 6 comprises a handle portion 25, a wand 26, a first locking mechanism, a wand-release mechanism 28, a second locking mechanism, and a support-release member 30. FIGS. 5 and 6 illustrate the wand assembly 6 in the region of the first locking mechanism and wand-release mechanism 28, and FIG. 7 illustrates the wand assembly in the region of the second locking mechanism and support-release member 30.

The handle portion 25 includes a body 31, a first gripping handle 32, a second gripping handle 33, and a covering cap 34.

A channel 35 is formed through the body 31 of the handle portion 25 and is dimensioned so that the wand 26 may be received within the channel 35. The body 31 further includes a support-receiving recess 36 for receiving one end of a support member 24 of the main body 2 of the vacuum cleaner 1.

The first handle 32 is shaped to provide a convenient gripping handle when manoeuvring the vacuum cleaner 1 in a conventional upright position, and the second handle 33 is shaped so as to provide a convenient gripping handle when manoeuvring the wand assembly 6 for above-the-floor cleaning. Although the first and second handles 32, 33 provide convenient means for manoeuvring the vacuum cleaner 1 and wand assembly 6, they are not essential and may be omitted. If one or both of the handles 32,33 are omitted, the body 31 of the handle portion 25 may instead be gripped in order to manoeuvre the vacuum cleaner 1 and/or the wand assembly 6. As a further alternative, the main body 2 of the vacuum cleaner 1 may include a handle for manoeuvring the vacuum cleaner 1 that is separate and distinct from the wand assembly 6.

The covering cap 34 is pivotally attached to the body 31 of the handle portion 25 and is pivotal between a closed position and an open position. In the closed position, the covering cap 34 covers an end of the wand-release mechanism 28 to prevent objects falling into the wand 26 when the wand assembly 6 is not in use. In the open position, the end of the wand-release mechanism 28 is uncovered so that the wand 26 may be withdrawn from the handle portion 25, as is described in further detail below.

The wand 26 comprises a tube 37 having a first end 38, a second end 39 and a linear groove 40 extending along the outer surface of the tube 37. The wand 26 is received within the channel 35 of the handle portion 25 and is moveable within the channel 35 in a direction parallel to the longitudinal axis of the channel 35 between a first position and a second position. A tongue 41 forming part of the body 31 of the handle portion 25 projects into the groove 40 so as to prevent rotational movement of the wand 26 relative to the handle portion 25 while permitting translation movement in the longitudinal direction.

The first position corresponds to a retracted position of the wand 26 in which the first end 38 of the wand 26 is remote from the handle portion 25 and the second end 39 of the wand 26 is proximate the handle portion 25 (e.g. FIGS. 1, 2 and 5). Conversely, the second position corresponds to a withdrawn position of the wand 26 in which the first end 38 of the wand 26 is proximate the handle portion 25 and the second end 39 of the wand 26 is remote from the handle portion 25 (e.g. FIGS. 3 and 4). As can be seen in FIG. 2, when the wand assembly 6 is mounted to the vacuum cleaner 1 and the wand 26 is in the retracted position, the wand 26 extends through the hose 11 and wand duct 10, and applies a downward force to the stirrup 15 of the changeover arrangement 7.

As can be seen in FIG. 7, the groove 40 terminates at a distance from the first end 38 of the tube 37 such that the tongue 41 prevents separation of the wand 26 from the handle portion 25 when withdrawing the wand 26, i.e. when moving the wand 26 from the retracted position to the withdrawn position. The wand-release mechanism 28, which is described below, prevents separation of the wand 26 from the handle portion 25 when retracting the wand 26, i.e. when moving the wand 26 from the withdrawn position to the retracted position.

Referring now to FIGS. 5 and 6, the first locking mechanism comprises a resilient catch 42 and a locking projection 43.

The resilient catch 42 is pivotally mounted to the body 31 of the handle portion 25 at a location adjacent the channel 35. The catch 42 comprises a cradle 44 having a base 45, a front wall 46, a rear wall 47, and two side walls (not visible in the Figures). A pivot arm 48 extends from each side wall in a direction towards and beyond the rear wall 47. The free end of each pivot arm 49 includes an outwardly projecting pin which is received by a recess in the body 31 of the handle portion 25 such that the catch 42 is free to pivot with respect to the handle portion 25. The catch 42 is mounted to the handle portion 25 such that the open face of the cradle 44 (i.e., that face opposite the base 45) is directed towards the centre of the channel 35. A torsion spring (not shown) is mounted around one of the pivot pins and provides a biasing force to the catch 42.

The catch 42 is moveable against the biasing force of the torsion spring between a lock position (FIG. 5) and an unlock position (FIG. 6). In the lock position, the biasing force of the spring urges the cradle 44 towards the centre of the channel 35. In the unlock position, the catch 42 pivots against the biasing force of the spring and urges the cradle 44 away from the centre of the channel 35.

The inner surface 53 of the rear wall 47 of the cradle 44 is ramped such that the rear wall 47 is thicker at the base 45 of the cradle 44. Moreover, the degree by which the inner surface 53 is ramped is such that, when the catch 42 is in the lock position, the inner surface 53 is inclined with respect to the longitudinal axis of the channel 35.

The locking projection 43 is located on the wand 26 proximate the second end 39 of the tube 37, and comprises a leading face 55 and a trailing face 56. The leading face 55 projects outwardly from the wand 26 in a plane that is substantially parallel to the outer surface 54 of the front wall 46 of the cradle 44, when in the lock position. As is explained in further detail below, this enables a secure lock to be formed between the catch 42 and the locking projection 43. The trailing face 56 curves convexly from the wand 26 to the outer edge of the leading face 55.

The catch 42 and locking projection 43 are arranged such that, when the wand 26 is in the retracted position and the catch 42 is in the lock position, as illustrated in FIG. 5, the leading face 55 of the locking projection 43 abuts the front wall 46 of the cradle 44. Movement of the wand 26 from the retracted position to the withdrawn position is thus prevented by the engagement of the catch 42 and the locking projection 43. Since the leading face 55 of the locking projection 43 is parallel to the outer surface 54 of the front wall 46 of the cradle 44, the force applied by the locking projection 43 to the catch 44 is distributed across a surface rather than at a point. Additionally, the force applied by the locking projection 43 to the catch 42 is directed towards the axis of rotation about which the catch 42 pivots; there is no (or little) force applied in a direction normal to the axis of rotation. Consequently, a secure lock is formed between the catch 42 and the locking projection 43.

When the catch 42 is in the unlock position, as is illustrated in FIG. 6, the cradle 44 clears the locking projection 43 and thus movement of the wand 26 from the retracted position to the withdrawn position is possible. The catch 42 and locking projection 43 are thus arranged such that movement of the wand 26 from the retracted position to the withdrawn position is prevented when the catch 42 is in the lock position and permitted when the catch 42 is in the unlock position.

Following use of the wand assembly 6, the wand 26 is returned from the withdrawn position to the retracted position. As the wand 26 nears the retracted position, the trailing face 56 of the locking projection 43 abuts the rear wall 47 of the cradle 44. As the wand 26 is retracted further, the curved surface of the trailing face 56 applies an increasing force to the cradle 44 causing the cradle 44 to pivot from the lock position to the unlock position. Finally, as the locking projection 43 clears the cradle 44, the catch 42 snaps back under the force of the torsion spring from the unlock position to the lock position. Retraction of the wand 26 from the withdrawn position is thus unhindered by the first locking mechanism.

The wand-release mechanism 28 comprises a sleeve 57 that surrounds the wand 26 and extends beyond the second end 39 of the wand 26. The portion of the sleeve 57 that extends beyond the wand 26 is dimensioned to receive one end of an accessory tool (not shown). However, it is not essential that the sleeve 57 extend beyond the wand 26 in order that accessory tools may be used with the wand assembly 6. As an alternative, the end of the wand 26 may extend beyond or be coterminous with the sleeve 57, and the end of the accessory tool is received within or around the end of the wand 26.

The sleeve 57 is moveable relative to the wand 26 and includes a locating stub 58 that projects into the groove 40 of the wand 26 such that rotational movement of the sleeve 57 is prevented while translational movement in a direction parallel to the longitudinal axis of the wand 26 is permitted. A recess 59 is provided in the inner surface of the sleeve 57, the recess 59 extending in a longitudinal direction, and the wand-release mechanism 28 further comprises a limiting stub 60 secured to the wand 26. The limiting stub 60 projects into the sleeve recess 59 and limits translation of the sleeve 57 relative to the wand 26 between a first position (FIG. 5) and a second position (FIG. 6). A compression spring 61 located between the locating stub 58 of the sleeve 57 and a brace 62 located on the wand 26 biases the sleeve 57 towards the first position.

A window 63 is formed in the sleeve 57 through which the locking projection 43 of the first locking mechanism projects. The sleeve 57 includes a release projection 64 located on the outer surface of the sleeve 57 between the window 63 and the open end of the sleeve 57 (i.e. the end of the sleeve 57 that extends beyond the wand 26). More specifically, the release projection 64 is located adjacent the window 63 and is aligned longitudinally with the locking projection 43. The release projection 64 includes a ramped face 65 (i.e. inclined to the longitudinal axis of the wand 26) such that the release projection 64 tapers towards the open end of the sleeve 57.

The wand-release mechanism 28 is actuated by applying an actuation force to the sleeve 57, which causes the sleeve 57 to move relative to the wand 26 in a direction parallel to the longitudinal axis of the wand 26. More specifically, the sleeve 57 moves in a direction from the retracted position to the withdrawn position. It is intended that the wand-release mechanism 28 is actuated by pulling the sleeve 57. Accordingly, the sleeve 57 is provided with a protuberance 66 which is intended to aid a user in gripping the sleeve 57 to pull and actuate the wand-release mechanism 28.

As can be seen in FIG. 5, the first locking mechanism and the wand-release mechanism 28 are arranged such that, when the wand 26 is in the retracted position, the release projection 64 projects into the cradle 44 of the catch 42, i.e. the release projection 64 projects into the recess formed by the base 45 and walls 46, 47 of the cradle 44. Upon actuating the wand-release mechanism 28, the sleeve 57 moves to the second position, as shown in FIG. 6. As the sleeve 57 moves relative to the wand 26, the release projection 64 abuts and pushes against the rear wall 47 of the cradle 44. Owing to the ramped inner surface 53 of the rear wall 47 as well as the ramped face 65 of the release projection 64, the release projection 64 applies an increasing force to the rear wall 47 as the sleeve 57 moves to the second position, thereby causing the catch 42 to pivot from the lock position to the unlock position. With the catch 42 in the unlock position, the wand 26 is free to move from the retracted position to the withdrawn position.

When the wand-release mechanism 28 is in the second position, any further actuation force applied to the wand-release mechanism 28 is transferred directly to the wand 26 by virtue of the limiting stub 60 that projects into the sleeve recess 59. Consequently, when the wand-release mechanism 28 is pulled by a user, the wand-release mechanism 28 is actuated and then the wand 26 is withdrawn.

The first locking mechanism ensures that the wand 26 cannot be withdrawn from the handle portion 25 when in the lock position. In particular, the wand 26 cannot be withdrawn from the retracted position upon application of a force directly to the wand 26. Consequently, when the wand assembly 6 is stowed on the main body 2 of the vacuum cleaner 1, as is illustrated in FIG. 2, the upward force applied by the changeover arrangement 7 to the wand 26 cannot bring about movement of the wand 26 within the handle 25. There is therefore no danger of the wand 26 inadvertently moving relative to the handle 25 when the vacuum cleaner 1 is used in the conventional upright position.

Although the first locking mechanism ensures that the wand 26 does not inadvertently move within the handle 25, the wand-release mechanism 28 provides a convenient means for both unlocking and then withdrawing the wand 26. In particular, by moveable mounting the wand-release mechanism 28 to the wand 26, the wand-release mechanism 28 can be pulled to both unlock and then withdraw the wand 26 from the handle portion 25. Consequently, the wand 26 can be unlocked and withdrawn by means of a single action. Moreover, since the user need only grip the wand-release mechanism 28, the wand 26 can be unlocked and withdrawn using only one hand.

Turning now to FIG. 7, the second locking mechanism comprises a locking collar 67 provided on the handle portion 25 and a lock recess 68 provided on the wand 26.

The locking collar 67 is substantially circular and includes a locking tab 69 that projects inwardly towards the centre of the collar 67. Diametrically opposite the locking tab 69 is a pin 70 which also projects inwardly towards the centre of the collar 67. The locking collar 67 is mounted within an annular recess in the body 31 of the handle portion 25 such that the collar 67 encircles the channel 35 and lies in a plane that is substantially normal to the longitudinal axis of the channel 35. The annular recess includes a portion that is open to the channel 35 and a portion that is closed to the channel 35 by a separating wall 71. The locking collar 67 is located within the annular recess such that the locking tab 69 lies within the portion that is open to the channel 35 and the pin 70 lies within the portion that is closed to the channel 35. The locking collar 67 is moveable within the annular recess between a lock position in which the locking tab 69 projects into the channel 35 and an unlock position in which the locking tab 69 does not project into the channel 35 (or projects into the channel 35 by a lesser amount). A compression spring 72 is mounted about the pin 70 of the locking collar 67 and extends between the locking collar 67 and the separating wall 71 such that locking collar 67 is biased in the lock position.

The lock recess 68 comprises a recess or indentation located on the wand 26 proximate the first end 38 of the tube 37. The lock recess 68 is dimensioned and located so as to receive the locking tab 69 of the locking collar 67 when the wand 67 is in the withdrawn position. The locking tab 69 and lock recess 68 thus engage to prevent movement of the wand 26 from the withdrawn position when the locking collar 67 is in the lock position.

The portion of the annular recess that is closed to the channel 35 by the separating wall 71 is open to the support-receiving recess 36. When the support member 24 of the vacuum cleaner 1 is received within the support-receiving recess 36, as is illustrated in FIG. 7, the end of the support member 24 abuts and pushes against the locking collar 67 in opposition to the biasing force of the compression spring 72. Consequently, the locking collar 67 is caused to move from the lock position to the unlock position. When in the unlock position, the locking tab 69 no longer projects into the lock recess 68 and thus the wand 26 is free to move from the withdrawn position.

The second locking mechanism thus ensures that the wand 26 cannot be retracted until such time as the wand assembly 6 is mounted to the vacuum cleaner 1 (i.e. until such time as the support member 24 is received within the support-receiving recess 36 of the handle portion 25). This then prevents the wand 26 from inadvertently retracting during use of the wand assembly 6. Moreover, without the provision of the second locking mechanism, it would be possible to retract the wand 26 while the wand assembly 6 is separated from the vacuum cleaner. Retracting the wand 26 into the hose 11 and then mounting the wand assembly 6 to the vacuum cleaner 1 might proof difficult for a user, particularly as the end of the wand 26 must be guided into the wand duct 10. Additionally, the end of the wand 26 presents an edge that may damage the hose 11 when the wand assembly 6 is separated from the vacuum cleaner 1. Damage to the hose 11 might also arise from pinching between the end of the wand 26 and the main body 2 of the vacuum cleaner 1 as an attempt is made to mount the wand assembly 6 to the vacuum cleaner 1. By preventing retraction of the wand 26 until such time as the wand assembly 6 is mounted to the vacuum cleaner 1, mounting and stowing the wand assembly 6 is simplified and methods of potentially damaging the hose 11 are avoided.

Remaining with FIG. 7, the support-release member 30 comprises a semi-circular collar having a stub 73 that projects inwardly from the middle of the collar. The support-release member 30 is held within a holding recess in the body 31 of the handle portion 25. A portion of the holding recess is open on one side to the channel 35 and open on the opposite side to the support-receiving recess 36.

The support-release member 30 is moveable within the holding recess in a direction normal to the longitudinal axis of the channel 35 (i.e. in a radial direction). In a first position the stub 73 projects into the channel 35, while in a second position a portion of the collar projects into the support-receiving recess 36. In FIG. 7, the support-release member 30 is in the first position.

The support-release member 30 is located within the handle portion 25 such that the stub 73 projects into the grove 40 of the wand 26 when the support-release member 30 is in the first position. As noted above, the groove 40 of the wand 26 terminates at a distance from the first end 38 of the wand 26. The support-release member 30 is located within the handle portion 25 such that, as the wand 26 approaches the withdrawn position, the stub 73 engages with the terminating wall 74 of the groove 40. The stub 73 is ramped (i.e. inclined with respect to the longitudinal axis of the channel 35 and wand 26) and the stub 73 ramps over the terminating wall of the groove 40 as the wand 26 is moved to the withdrawn position. This causes the support-release member 30 to move radially outwards from the first position to the second position.

The support member 24 of the vacuum cleaner 1 includes a support catch 75 that is pivotally mounted to the support member 24 and is biased by a spring (not shown) between a lock position and an unlock position. In the lock position, an end of the support catch 75 engages with a wall 76 inside the support-receiving recess 36 such that the handle portion 25, and thus the wand assembly 6, cannot be separated from the support member 24. In the unlock position, the support catch 75 clears the wall 76 such that the handle portion 25, and thus the wand assembly 6, can be separated from the support member 24.

When the support member 24 is received within the support-receiving recess 36, the support catch 75 abuts the support-release member 30. With the wand 26 in the retracted position, the support catch 75, under the biasing force of the spring, moves the support-release member 30 to the first position, as is illustrated in FIG. 7. However, when the wand 26 is withdrawn, the support-release member 30 moves from the first position to the second position, thereby moving the support catch 75, against the biasing force of the spring, to the unlock position. Consequently, when the wand 26 is in the retracted position, the support catch 75 and support-release member 30 cooperate to prevent separation of the wand assembly 6 from the vacuum cleaner 1. Conversely, when the wand 26 is in the withdrawn position, the support catch 75 and support-release member 30 cooperate to permit separation of the wand assembly 6 from the vacuum cleaner 1.

The support catch 75 and support-release member 30 therefore ensure that the wand assembly 6 cannot be separated from the vacuum cleaner 1 until such time as the wand 26 is fully withdrawn. This arrangement has the advantage of aiding single-handed withdrawal of the wand 26 since the handle portion 25 is effectively locked to the vacuum cleaner 1 until the wand 26 is fully withdrawn. Additionally, for reasons already set out above, the hose 11 may be damaged when the wand assembly 6 is separated from the vacuum cleaner 1 and the wand 26 is retracted within the hose 11. In particular, the end 38 of the wand 26 may present an edge that may damage the hose 11. Accordingly, by preventing separation of the wand assembly 6 from the vacuum cleaner 1 until such time as the wand 26 is fully withdrawn, potential damage to the hose 11 is averted.

The wand assembly 6 of the present invention is therefore ideally suited for use in actuating a changeover arrangement 7 of a vacuum cleaner 1. The first locking mechanism ensures that the wand 26 is securely held within the handle portion 25, and the support catch 75 ensures that the handle portion 25 is securely held to the vacuum cleaner 1. Moreover, the wand-release mechanism 28 provides a quick and simple means for unlocking and withdrawing the wand 26, while the support-release member 30 responds to the withdrawal of the wand 26 to unlock the handle portion 25 from the vacuum cleaner 1. A synergy therefore arises between the wand-release mechanism 28 and the support-release member 30 whereby a user is able to unlock and withdraw the wand 26 from the handle 25, and unlock and separate the handle 25 from the vacuum cleaner 1 all by means of a single action that can be performed using only one hand.

Although a specific embodiment of the wand assembly 6 has thus far been described, different arrangements for each of the first locking mechanism, the wand-release mechanism 28, the second locking mechanism, and the support-release member 30 may equally be employed that achieve the same or similar results and advantages.

For example, in the embodiment described above, the first locking mechanism comprises a resilient catch 42 located on the handle portion 25 and a locking projection 43 located on the wand 26, the catch 42 and locking projection 43 engaging with one another when the wand 26 is in the retracted position so as to prevent movement of the wand 26 to the withdrawn position. However, the same result, namely the prevention of movement of the wand 26 from the retracted position, may equally be achieved by other means. For example, the locking projection 43 may be replaced by a recess or indentation in the wand 26, into which the catch 42 projects to lock the position of the wand 26. As a further alternative, the resilient catch 42 may be provided on the wand 26 and the locking feature (e.g. projection or recess) with which the resilient catch 42 engages may be provided on the handle portion 25. In this further alternative, the wand-release mechanism 28 might be adapted such that the resilient catch 42 projects through the window 63 in the sleeve 57. Consequently, as the sleeve 57 is moved relative to the wand 26 (i.e. as the sleeve 57 is pulled), the sleeve 57 slides over the resilient catch 42, causing the catch 42 to pivot from the lock position to the unlock position.

In the embodiment described above, the wand-release mechanism 28 is actuated by translating the sleeve 57 in a direction parallel to the longitudinal axis of the wand 26. However, the wand-release mechanism 28 might alternatively be adapted such that it is actuated upon rotating the sleeve 57 about the longitudinal axis of wand 26, translating the sleeve 57 in a direction normal to the longitudinal axis (i.e. in a radial direction), or any combination of translational and rotational movement.

By way of example only, rotational actuation might be achieved by adapting the sleeve recess 59 into which the limiting stub 60 projects such that it extends circumferentially rather than longitudinally around the sleeve 57. Additionally, the locating stub 58 which projects into the groove 40 of the wand 26 would be omitted so as to permit rotational movement of the sleeve 57 relative to the wand 26. The release projection 64 would also be ramped circumferentially rather than longitudinally such that an increasing force is applied to the catch 42 of the first locking mechanism as the sleeve 57 is rotated. Finally, the resilient catch 42 of the first locking mechanism could be arranged such that the axis of rotation about which the catch pivots is parallel rather than normal to the longitudinal axis of the channel 35.

Although the wand-release mechanism 28 may be configured for actuation upon different directions of movement, the wand-release mechanism 28 continues to be mounted to the wand 26. Consequently, the wand-release mechanism 28 maintains the advantage of providing single-handed release and withdrawal of the wand 26 from the handle portion 25. In particular, a first force may be applied to the wand-release mechanism 28 in order to actuate the wand-release mechanism 28 and unlock the wand 26, and a subsequent second force may be applied to the wand-release mechanism 28 in order to withdraw the wand 26 from the handle portion 25. For example, in the case of rotational actuation, the wand 26 is withdrawn by first rotating and then pulling the wand-release mechanism 28.

Different arrangements are also possible for the second locking mechanism. For example, rather than having an arrangement that is unlocked only when the support member 24 is received within the handle portion 25, the second locking mechanism may be adapted such that it is unlocked in response to user actuation. For example, the locking collar 67 may be replaced by a resilient catch that is biased towards the channel 35 and engages with the lock recess 68 in the wand 26. The user then depresses an end the catch to disengage the catch from the lock recess 68.

Similarly, alternative arrangements are possible for the support-release member 30 and support catch 75. For example, the stub 73 may be omitted from the support-release member 30, and the wand 26 may instead have a ramped shoulder (i.e. a gradual increase in diameter) at the first end 38 of the wand 26 which engages and moves the support-release member 30 as the wand 26 is moved to the withdrawn position. Indeed, the support-release member 30 may be omitted altogether and the support catch 75 may be adapted such that it is actuated by the user to release the handle portion 25. Moreover, the support catch 75 may be provided on the handle portion 25 rather than on the support member 24.

Although the support catch 75 and support-release member 30 ensure that the wand assembly 6 is locked to the vacuum cleaner 1 until such time as the wand 26 is withdrawn, there may nevertheless be instances in which the support catch 75 and the support-release member 30 may be omitted without jeopardising the ability of the wand assembly 6 to actuate the changeover arrangement 7. For example, the weight of the wand assembly 6 may be sufficient to overcome the biasing force from the changeover arrangement 7, a force which the weight of the wand 26 alone could not overcome. Alternatively or additionally, the frictional forces that arise from the interference fit of the support member 24 and handle portion 25 may be sufficient to overcome the biasing force of the changeover arrangement 7.

In the above description of the wand assembly 6, the terms 'projection', 'stub' and 'tab' are intended to have the same meaning, namely a projecting or protruding part. The different terms have been used merely for the purpose of clarity, and in particular to distinguish similar features that appear on different components of the wand assembly 6.

Although reference has thus far been made to a wand assembly in use with an upright vacuum cleaner, the wand assembly may equally be employed with other types of cleaning appliance having a changeover arrangement for switching operation between a main cleaner head (or other cleaning tool) and a wand assembly. In particular, the wand assembly 6 may be used with cleaning appliances that both carry a fluid from a surface (e.g. dry, wet and wet/dry vacuum cleaners) and carry a fluid to a surface (e.g. polishing/waxing machines and shampooing machines).

The invention claimed is:

1. A wand assembly for a cleaning appliance comprising:

a handle portion having a channel formed therethrough;

a tubular wand received within the channel and moveable within the channel between a first position and a second position;

a first locking mechanism moveable between a lock position and an unlock position, the first locking mechanism preventing movement of the wand from the first position when in the lock position and permitting movement of the wand from the first position when in the unlock position; and a release mechanism that can be actuated to move the first locking mechanism from the lock position to the unlock position, wherein the release mechanism is mounted to the wand such that the release mechanism moves with the wand when the wand moves relative to the handle portion, and the release mechanism is actuated by relative movement of the release mechanism with respect to the wand.

2. The wand assembly of claim 1, wherein the release mechanism is configured so that applying a first force to the release mechanism causes the release mechanism to move relative to the wand to actuate the release mechanism and applying a subsequent second force to the release mechanism causes the wand to move from the first position to the second position.

3. The wand assembly of claim 2, wherein the first force and second force are in a direction from the first position to the second position.

4. The wand assembly of claim 1 or 2, wherein the first locking mechanism comprises a locking feature and a catch moveable between a lock position and an unlock position, the locking feature being located on one of the handle portion and the wand and the catch being located on the other of the handle portion and the wand, and wherein the catch engages the locking feature when in the lock position to prevent movement of the wand from the first position, and the release mechanism can be actuated to move the catch from the lock position to the unlock position to disengage the catch from the locking feature to thus permit movement of the wand from the first position.

5. The wand assembly of claim 4, wherein the catch is moveable against a biasing force between the lock position and the unlock position, and actuation of the release mechanism applies an opposing force to the catch in opposition to the biasing force to thereby move the catch from the lock position to the unlock position.

6. The wand assembly of claim 5, wherein actuation of the release mechanism causes the release mechanism to move from a first position to a second position, a surface of the release mechanism abuts a surface of the catch to apply the opposing force, and at least one of the surface of the release mechanism and the surface of the catch is ramped such that the strength of the opposing force increases as the release mechanism is moved from the first position to the second position.

7. The wand assembly of claim 6, wherein the catch is pivotally mounted to the handle portion, the locking feature is located on the wand, and the release mechanism comprises a sleeve that surrounds one end of the wand, and wherein the sleeve includes a projection which abuts and applies the opposing force to the catch as the release mechanism is moved to the second position.

8. The wand assembly of claim 1 or 2, wherein the release mechanism comprises a sleeve that surrounds one end of the wand and is configured to receive one end of an accessory tool.

9. The wand assembly of claim 1 or 2, wherein the handle portion is mountable to a support member of a cleaning appliance, one of the handle portion and the support member comprises a support catch moveable between a lock position and unlock position in which separation of the wand assembly from the cleaning appliance is respectively prevented and permitted, and the wand assembly further comprises a support-release member arranged to move the support catch from the lock position to the unlock position in response to the wand moving to the second position.

10. The wand assembly of claim 9, wherein the support-release member abuts both the wand and the support catch when the handle portion is mounted to the support member, and the wand and support-release member cooperate such that the support-release member is caused to move in a direction towards the support catch in response to the wand moving to the second position to thus move the support catch to the unlock position.

11. The wand assembly of claim 10, wherein the wand includes a groove having a terminating wall, and the support-release member includes a stub that projects into the groove, and wherein at least one of the terminating wall and the stub is ramped such that, as the wand is moved to the second position, the stub engages the terminating wall and the support-release member is thus caused to move in a direction towards the support catch.

12. The wand assembly of claim 1 or 2, wherein the wand assembly further comprises a second locking mechanism moveable between a lock position and an unlock position, the second locking mechanism being configured to prevent movement of the wand from the second position when in the lock position and permitting movement of the wand when in the unlock position.

13. The wand assembly of claim 12, wherein the handle portion is mountable to a support member of the cleaning appliance, and the second locking mechanism is arranged to move from the lock position to the unlock position in response to mounting the handle portion to the support member.

14. The wand assembly of claim 13, wherein the further locking mechanism comprises a catch mounted to the handle portion which engages with a feature located on or in the wand to prevent movement of the wand from the second position, and the catch is arranged to engage with the support member when mounted to the handle portion, and wherein the engagement of the catch and support member causes the catch to move to the unlock position.

15. A vacuum cleaner comprising the wand assembly of claim 1 or 2.

16. A cleaning appliance comprising a cleaner head, the wand assembly of claim 1 or 2, and a changeover arrangement operable to select one of the cleaning head and the wand assembly, wherein the wand assembly is releasably mounted to the cleaning appliance and the changeover arrangement selects the cleaner head when the wand of the wand assembly is in the first position and selects the wand assembly when the wand is in the second position.

17. A cleaning appliance as claimed in claim 16, wherein the changeover arrangement is configured to apply a force to the wand when the wand assembly is mounted to the cleaning appliance and the wand is in the first position, the force having a component which urges the wand to move to the second position.

18. A vacuum cleaner comprising the cleaning appliance of claim 16.

19. A cleaning appliance comprising:

a handle portion having a channel;

a tubular wand received within the channel and moveable relative to the handle portion;

a locking mechanism moveable between a lock position and an unlock position, the locking mechanism preventing movement of the wand relative to the handle portion when in the lock position and permitting movement of the wand relative to the handle portion when in the unlock position; and a release mechanism that can be actuated to move the locking mechanism from the lock position to the unlock position, wherein the release mechanism is mounted to the wand such that the release mechanism moves with the wand when the wand moves relative to the handle portion, and the release mechanism is actuated by relative movement of the release mechanism with respect to the wand.

20. A cleaning appliance comprising:

a handle portion;

a tubular wand;

a locking mechanism moveable between a lock position and an unlock position, the locking mechanism preventing movement of the wand relative to the handle portion when in the lock position and permitting movement of the wand relative to the handle portion when in the unlock position; and a release mechanism that is mounted to the wand and can be actuated to move the locking mechanism from the lock position to the unlock position, wherein the release mechanism is actuated by translating the release mechanism relative to the wand in a direction parallel to a longitudinal axis of the wand or by rotating the release mechanism relative to the wand about the longitudinal axis.

21. A cleaning appliance comprising:

a handle portion;

a tubular wand;

a locking mechanism moveable between a lock position and an unlock position, the locking mechanism preventing movement of the wand relative to the handle portion when in the lock position and permitting movement of the wand relative to the handle portion when in the unlock position; and a release mechanism actuable to move the locking means from the lock position to the unlock position, wherein the release mechanism comprises a sleeve that surrounds an end of the wand and is actuated by relative movement of the sleeve with respect to the wand.

22. An upright vacuum cleaner comprising:

a handle portion;

a tubular wand;

a locking mechanism moveable between a lock position and an unlock position, the locking mechanism preventing movement of the wand relative to the handle portion when in the lock position and permitting movement of the wand relative to the handle portion when in the unlock position; and a release mechanism that can be actuated to move the locking mechanism from the lock position to the unlock position, wherein the release mechanism is mounted to the wand such that the release mechanism moves with the wand when the wand moves relative to the handle portion, and the release mechanism is actuated by relative movement of the release mechanism with respect to the wand.

23. A cleaner as claimed in claim 22, wherein the release mechanism is actuated by translating the release mechanism relative to the wand in a direction parallel to a longitudinal axis of the wand or by rotating the release mechanism relative to the wand about the longitudinal axis.

24. A cleaner as claimed in claim 22, wherein the release mechanism comprises a sleeve that surrounds an end of the wand.

* * * * *

UNITED STATES PATENT AND TRADEMARK OFFICE

CERTIFICATE OF CORRECTION

PATENT NO. : 8,327,504 B2
APPLICATION NO. : 12/338785
DATED : December 11, 2012
INVENTOR(S) : Daniel F. Helps et al.

It is certified that error appears in the above-identified patent and that said Letters Patent is hereby corrected as shown below:

On the front page, section (30) Foreign Application Priority Data has been omitted, please add the following information:

--Dec. 22, 2007 (GB).....0725133.3--

Signed and Sealed this
Twelfth Day of February, 2013

Teresa Stanek Rea
*Acting Director of the United States Patent and Trademark Office*